United States Patent [19]

Fennekels et al.

[11] 4,448,581

[45] May 15, 1984

[54] PROCESS FOR WASHING DYED OR PRINTED TEXTILE MATERIALS

[75] Inventors: Peter Fennekels; Ernst Waltmann, both of Krefeld, Fed. Rep. of Germany

[73] Assignee: Girmes-Werke AG, Grefrath, Fed. Rep. of Germany

[21] Appl. No.: 484,709

[22] Filed: Apr. 14, 1983

[30] Foreign Application Priority Data

Apr. 15, 1982 [DE] Fed. Rep. of Germany ..... 3213840

[51] Int. Cl.[3] ..... B08B 7/04; B08B 3/00; C11D 9/42; C11D 1/02

[52] U.S. Cl. ..... 8/137; 8/553; 8/149.3

[58] Field of Search ..... 8/137, 149.3, 553

[56] References Cited

U.S. PATENT DOCUMENTS 4,314,804 2/1982 Fennekels et al. ..... 8/137
4,403,359 9/1983 Kutz .

*Primary Examiner*—Maria Parrish Tungol

*Attorney, Agent, or Firm*—Schwartz, Jeffery, Schwaab, Mack, Blumenthal & Koch

[57] ABSTRACT

A process for the washing or rinsing of dyed or printed, continuously advancing width of textile materials, whereby a foam is uniformly applied to one side of the textile material. The foam is produced from a liquid containing one or several surface active agents, together with a compound soluble in the liquid, and having no affinity to the fibers of the textile material to be treated, but displaying a high adsorption capacity for the substances to be washed from the textile material. Immediately following the application of the foam, the widths of the textile material are exposed to a steam treatment and then rinsed. A two-stage embodiment of the process in which immediately preceding the application of the foam a similar foam is applied and removed together with a part of the substances to be washed or rinsed from the textile material. The second stage, which includes the steam treatment, then merely removes the residual substances to be washed or rinsed out.

16 Claims, No Drawings

PROCESS FOR WASHING DYED OR PRINTED TEXTILE MATERIALS

BACKGROUND OF THE INVENTION

1. Field of the Invention

The invention relates to a process for washing dyed or printed textile materials consistent with the known process of U.S. Pat. No. 4,314,804. More particularly, the invention concerns a modification or improvement of the process of U.S. Pat. No. 4,314,804, wherein an additional steam treating step is employed in a particular fashion.

2. Background of the Prior Art

In West German Pat. No. 29 03 134 and the corresponding U.S. Pat. No. 4,314,804, a process for the washing or rinsing of dyed or printed textile materials is described wherein a foam is applied uniformly to continuously advancing widths of textile goods. The foam is produced from a liquid containing one or several surface active agents and a compound soluble in the liquid having substantially no affinity with the fibers of the textile materials being treated, but a high adsorption capacity for the substances to be washed or rinsed from the textile material.

The steaming of materials after the application of a thickened foam for its removal by washing is known from West German Offenlegungsschrift No. 30 26 349. However, in this reference, the foam contains only a wetting agent and possibly a foaming agent and no other auxiliary substances. West German Offenlegungsshrift No. 30 26 349, thus provides no teaching of employing adsorbent compounds in foams for the enhancement of the effectiveness of the foam.

SUMMARY OF THE INVENTION

It has been found that the effectiveness of the process described in U.S. Pat. No. 4,314,804 is surprisingly enhanced by subjecting the textile material immediately after the application of the foam, to a steam treatment, followed by a rinse step.

Thus, the improved process of the instant invention comprises washing dyed or printed textile materials in a continuous fashion by uniform application to the textile materials of a foam containing a surface active agent and a compound having substantially no affinity for the fibers of the textile materials, and a substantial adsorption capacity for the substances to be removed from the textile materials, application of steam to the textile materials immediately following the application of foam, and rinsing the textile material after the application of steam.

The foams described in the instant invention are said to contain an adsorption-enhancing agent or merely an adsorption compound. This compound or agent is the compound soluble in the liquid forming the foam and having substantially no affinity for the fiber of the textile materials while having a substrated adsorption capacity of the substances to be removed from the textile materials.

The enhancement of the effectiveness of the process by this measure may possibly be explained by a phenomenon wherein the steam treatment favors the adsorption of the substances to be washed or rinsed out of the compound.

In a preferred embodiment, the steam treatment may be effected with saturated steam at approximately 100° C. or, alternatively, with high pressure saturated steam at a temperature of 130° to 170° C.

In a most preferred embodiment, the foam is applied in a quantity so that the widths of the textile goods are completely saturated at least at the onset of the steam treatment with the foam or the liquid originating in it.

The quantity of foam to be applied in individual cases depends in particular on its $m^2$ weight and the volume of the goods, as well as on the nature of the foam used. The degree of foaming is especially important. The necessary amount is naturally determined in individual cases on an experimental basis.

As an important preferred embodiment of the invention, it has been found that immediately prior to the application of the foam, a pretreatment with foam followed by removal of the foam by suction or squeezing (together with a part of the substances to be removed by washing or rinsing) greatly enhances the results obtained. This applies particularly in the washing of pile materials with high weights per unit area e.g. weights approximately 400 to more than 1000 $g/m^2$ and with different heights of the pile.

The fundamental concept of one embodiment of the invention thus comprises an improvement in the process of U.S. Pat. No. 4,314,804 as a so-called two-stage process. In the first stage, the foam containing the adsorption enhancing agent is applied and then removed by suction or pressing, together with an appreciable part of the substances to be washed or rinsed out. In one embodiment, the suction is applied from the side opposite the side of application of the foam to the widths of textile goods, as described in U.S. Pat. No. 4,314,804. The widths of the textile material are then already precleansed and are exposed in this condition to the application of the second layer of foam. Subsequently, the textile materials are passed continuously through the steamer with saturated steam at approximately 100° C. or a high pressure saturated steam boiler at a temperature of 130° to 170° C. (depending on the fiber material). After leaving the steamer, the textile materials are rinsed with warm water in order to remove even the last residues of the substances to be washed or rinsed out.

The foams to be applied in the two stages have the same fundamental composition, i.e. in particular, they both contain an adsorbant compound. However, it is not required that they be identical. In the preferred embodiment, both foams are identical and costs in this manner are substantially reduced because both installations for the application of the foam may be supplied by a single foam-generating apparatus.

The density and amount of the foam is controlled consistent with the nature of the textile material to be washed and is determined in particular by the color fastness of the material with respect to wet treatments. The principal purpose is to remove only the unabsorbed, excess dye. The process and the adsorbing compound, therefore, are directed primarily and specifically at the adsorption of the excess dye.

The foam is produced from a liquid containing a surface active compound and the adsorption agent. Anionic surface compounds are preferred. Preparation of the foam and the various agents comprising the foam are described in U.S. Pat. No. 4,314,804. The entire disclosure of U.S. Pat. No. 4,314,804 is incorporated herein by reference.

In addition to known anionic surface active agents, alkali salts of an n-alkyl sulfate, n-alkylbenzene sulfate or n-methyl-N-oleolyl taurate or alkali or ammonia salts of a fatty acid with not less than 12 carbon atoms and non-ionic surface active agents, such as alkylpolyglycol ethers or oxyethylated alkylphenol are employed. For pile materials used as furniture fabrics having a pile of acryl or modacryl fibers, the surfactant is a non-ionic surface active agent in a mixture with a compound having a high adsorbing capacity for cationic dyes. The following dye adsorbing agents are suitable in the instant invention: products based on a quaternary ammonium compound, such as the products commercially available under the trademark RETARGAL AN or an alkylammonium polyglycol ether, sold under the trademark LEVAPON MR.

The foam is applied in the two-stage process. Each stage is conducted under conditions described in U.S. Pat. No. 4,314,804. For example, the foam is applied at a temperature of 60° to 95° C. According to the instant invention, however, the hot foam may be effected from both sides, i.e. in the case of pile fabrics, both on the pile side and on the reverse side. In a preferred embodiment, the first foam is applied to the back of the pile fabric and is passed through the goods and removed from the pile side, whereupon the second foam is applied to the pile side.

The foam is "made to pass" through the material conveniently by suction from the side opposite the application side or by overpressure from the side of application or by other types of mechanical effects.

The invention provides a process whereby, in a continuous operation and with relatively rapid operating rate, a uniform treatment result is obtained in the washing and rinsing in particular of excess dyestuffs from the material. As manifested by the experiments, it is possible only by using a foam with an adsorbing compound to obtain such a treatment effect without the occurrence of the color migration phenomena in the steamer.

Further objects, features and advantages of the present invention will become apparent to a person of ordinary skill in the art from the detailed description of preferred embodiments and from the examples which follow.

EXAMPLE I

A cut width of a tufted, pile floor covering having width of 5 m, a weight of 1000 g per $m^2$ and a fiber content as follows:

pile: polyamide fibers
warp: pure cotton
woof: pure cotton is dyed a brown color after prewashing on a continuous dying line in an aqueous bath by the pad-stream process. The width of the material advancing after the dying is then treated to a foaming step with the pile down in a horizontal and flat position on the reverse side, uniformly in a thickness of approximately 10 cm. The foam is produced from a liquid containing two anionic surface active agents in a quantity of 20 g/l water and polyvinyl pyrrolidone in a quantity of 30 g/l water. The liquid is at a temperature of 60°–95° C. It is beaten into foam mechanically at a volume ratio of 1:8 and applied to the textile material by means of a suitable device, for example, a hose with a mobile pipe fitting. The temperature of the foam is approximately 95° C. The width of material then passes over a suction slit or a suction roll, whereby the foam loaded with the unabsorbed dye and other accompanying substances is suctioned from the materials. Immediately thereafter, the second foam of the same liquid composition is applied to the appropriately reversed material, this time from the pile side. The width of material saturated in this manner with the foam then passes directly into the steamer, in which a treatment with saturated steam at an approximate temperature of 100° C. is effected over a period of approximately 0.5 to 4 min. The treatment in the steamer is followed by a brief afterrinse with hot water containing no additives.

EXAMPLE II

A velvet fabric, width 120 cm, weight per $m^2$ 500 g, and the following fiber content:

pile: pure cotton
warp: pure cotton
woof: pure cotton is dyed essentially black after the usual prewashing in an aqueous bath. The width of material advancing after dying is then treated on the reverse side uniformly with the foam with the pile downward in a horizontal and flat position in a thickness of 5 cm. The composition of the foam is as cited hereinabove. The temperature of the foam is approximately 95° C. The width of the material then passes over a suction slit or a suction roll, whereby the foam loaded with dye and other accompanying substances is drawn from the material. Immediately thereafter, the second foam is applied. The foam is of the same composition, but is applied this time from the pile side to the appropriately turned material. Directly after this, the width of material passes into a high pressure saturated steam boiler with the temperature of the saturated steam at 130° C. and the treatment period being 0.2 to 1 min. By using a high pressure saturated steam boiler, the duration of the steam effect may be substantially shortened. Upon leaving the high pressure saturated steam boiler, the material is briefly rinsed with hot water without additives. The further processing and impregnation of the cotton velvet is effected subsequently by conventional methods.

The above description describes a preferred embodiment of the invention. It is to be understood however, that the invention is not limited to any single embodiment or feature, but should be construed to cover all modifications and alternative embodiments falling within the scope of the invention as defined by the claims which follow.

What is claimed is:

1. A process for washing dyed or printed textile materials comprising:

uniformly applying a foam to one side of the textile material, said foam comprising at least one surface active agent, and a compound soluble in the foam-forming liquid having substantially no affinity to the fibers of the textile material, and having a high adsorption capacity for the substances to be washed out of the textile material;

applying steam to the textile material immediately following the application of the foam, and rinsing the textile material after said application of steam.

2. The process of claim 1, wherein said textile materials move continuously through a station where said foam application, steam application and rinse steps occur.

3. The process of claim 2, wherein said steam application is effected with saturated steam at approximately 100° C.

4. The process of claim 2, wherein said steam application is effected with high pressure saturated steam at a temperature of 130° to 170° C.

5. The process of claim 2, wherein said foam application saturates the width of the textile material in said station at least until the onset of the steam treatment.

6. The process of claim 2, wherein said surface active agent is selected from the group consisting of alkali metal salts of n-alkylsulfates, n-alkylbenzene sulfates or the n-methyl-N-oleolyl taurate or alkali or ammonium salts of fatty acids having not less than 12 carbon atoms.

7. The process of claim 6, wherein said compound soluble in the foam-forming liquid is polyvinylpyrrolidone.

8. A process for washing dyed or printed textile materials comprising:

applying a first foam to the textile material, said foam comprising at least one surface active agent and a compound soluble in the foam-forming liquid having substantially no affinity to the fibers of the textile material, and having a high adsorption capacity for the substances to be washed out of the textile material;

removing said first foam from said textile material;

uniformly applying a second foam to one side of the textile fabric said foam comprising at least one surface active agent, and a compound soluble in the foam-forming liquid having substantially no affinity to the fibers of the textile material, and having a high adsorption capacity for the substances to be washed out of the textile material;

applying steam to the textile material immediately following the application of said second foam, and rinsing the textile material after said application of steam.

9. The process of claim 8, wherein said first foam and said second foam are identical.

10. The process of claim 8, wherein said removing step is removing by suction of said first foam from said textile material.

11. The process of claim 8, wherein said removing step is removing by pressing.

12. The process of claim 8, wherein said textile materials move continuously through a station where said foam application, steam application and rinse steps occur.

13. The process of claim 8, wherein said first foam is applied to the side of said textile material opposite the pile and said removing step is by removal from said pile side of the textile material.

14. The process of claim 13, wherein said application of said second foam is application to said pile side of the textile material.

15. The process of claim 8, wherein said surface active agent is selected from the group consisting of alkali metal salts of n-alkylsulfates, n-alkylbenzene sufates or the n-methyl-N-oleolyl taurate or alkali or ammonium salts of fatty acids having not less than 12 carbon atoms.

16. The process of claim 8, wherein said compound soluble in the foam-forming liquid is polyvinylpyrrolidone.

* * * * *